US007730940B2

(12) United States Patent
Knippa et al.

(10) Patent No.: US 7,730,940 B2
(45) Date of Patent: Jun. 8, 2010

(54) SPLIT BODY SWELLING PACKER

(75) Inventors: Jeffery L. Knippa, Point Venture, TX (US); Mark J. Knebel, Tomball, TX (US); Edward T. Wood, Kingwood, TX (US); Larry D. Johnson, Al Khobar (SA)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 11/968,899

(22) Filed: Jan. 3, 2008

(65) Prior Publication Data

US 2008/0210418 A1 Sep. 4, 2008

Related U.S. Application Data

(60) Provisional application No. 60/880,630, filed on Jan. 16, 2007.

(51) Int. Cl.
*E21B 23/06* (2006.01)

(52) U.S. Cl. ..... 166/118

(58) Field of Classification Search ..... 166/241.7, 166/118, 206, 180
See application file for complete search history.

(56) References Cited

U.S. PATENT DOCUMENTS 4,266,578 A * 5/1981 Swain et al. ..... 138/110
6,834,725 B2 * 12/2004 Whanger et al. ..... 166/384
7,143,832 B2 * 12/2006 Freyer ..... 166/387
7,441,596 B2 10/2008 Wood et al.
7,552,768 B2 6/2009 O'Brien
7,562,794 B2 7/2009 Van De Braak et al.
2005/0110217 A1 5/2005 Wood et al.
2007/0012436 A1 * 1/2007 Freyer ..... 166/179
2009/0084550 A1 4/2009 Korte et al.
2009/0139708 A1 * 6/2009 Foster ..... 166/118

* cited by examiner

*Primary Examiner*—David J Bagnell
*Assistant Examiner*—James G Sayre
(74) *Attorney, Agent, or Firm*—Steve Rosenblatt

(57) ABSTRACT

A swelling packer system uses modules that can be joined together and mounted over a tubular using a vertical split that can be drawn closed with a tapered pin in overlapping loops. The pins are circumferentially spaced apart as between adjacent modules. End rings can protect the modules for run in and act as extrusion barriers during and after the swelling is complete. The module ends can be overlapped in an interlocking fashion which allows multiple elements to be joined together to make a packer assembly as long as desired with any combination of swelling elements in a single packer assembly. Optionally, interior grooves in the swelling material can hold split ring seals or o-ring type seals that are slipped over a tubular end before a module is clamped on. The sealing elements can be triggered with water or hydrocarbons or with other materials already in the wellbore or introduced to it or other surface or locally actuated triggers.

20 Claims, 2 Drawing Sheets

SPLIT BODY SWELLING PACKER

PRIORITY INFORMATION

This application claims the benefit of U.S. Provisional Application No. 60/880,630, filed on Jan. 16, 2007.

FIELD OF THE INVENTIONS

The field of this invention is downhole packers and more particularly those with elements that swell and that have a split body with a design allowing multiple elements to be joined together to make a packer assembly that can be mounted and secured over a tubular and seal a surrounding annular space.

BACKGROUND OF THE INVENTION

Packers are used for zone isolation downhole. They are available in a variety of designs and are integrated into a tubular string for proper positioning in a wellbore. Some are set with pressure and others with applied force from the tubular string to which they are attached. More recently packers have been developed that swell in the presence of fluids in or added to the wellbore. Some of these packers swell in the presence of water and others in the presence of hydrocarbons. Such packers can be used on casing or tubular strings running through casing.

These swelling packers are prefabricated into a pup joint that can be made part of a longer string. Generally the swelling element is wrapped around the pup joint, bonded and cured directly to the outer wall of the pup joint. Other designs have used a swelling material on a cylindrical housing that is slipped over the casing or tubing. However, such designs are a set length and do not provide a means of joining additional segments to make the packer longer or combine both water and oil swell elastomers in a single packer assembly. Also the rigid housing can cause problems running in the hole and can make sealing between the housing and the tubular difficult. In essence, they act as a barrier in the annulus but not as a pressure seal between wellbore sections. Clamp on pipe protectors which attach to drill pipe are used to protect the casing from wear caused by rotating and reciprocating the drill pipe. An example of such clamp type pipe protector is U.S. Pat. No. 4,266,578.

The present invention provides a swelling seal that has a split to allow encircling the tubular and securing it to the tubular. It is a modular design that can use an interlocking feature among sealing modules. Multiple element modules can be joined together to make a packer assembly as long as desired using all oil swell, all water swell, or a combination of oil and water swell elements. End rings can serve to protect the assembly during run in and to act as extrusion barriers once the packer is in position and the elements are swollen. The modules can have an embedded body that closes around a tubular with offset tapered loops that can be drawn together with a tapered pin that is driven into position to tighten the element onto the tubular. Excess length of the tapered pin is trimmed off to allow additional elements to be added which interlock with the previously installed element. The pins and the joints they close are circumferentially offset to prevent straight through leak paths among modules. The split design also allows these packer assemblies to be installed on tubulars other than casing such as sand screens, drill pipe, or other tools with a round profile. These and other features of the present invention will be more readily understood by those skilled in the art from a review of the preferred embodiment and the associated drawings while recognizing that the full scope of the invention is to be determined by the claims appended below.

SUMMARY OF THE INVENTION

A swelling packer system uses modules that can be joined together and mounted over a tubular using a vertical split that can be drawn closed with a tapered pin in overlapping loops. The pins are circumferentially spaced apart as between adjacent modules. End rings can protect the modules for run in and act as extrusion barriers during and after the swelling is complete. The module ends can be overlapped in an interlocking fashion which allows multiple elements to be joined together to make a packer assembly as long as desired with any combination of swelling elements in a single packer assembly. Optionally, interior grooves in the swelling material can hold split ring seals or o-ring type seals that are slipped over a tubular end before a module is clamped on. The sealing elements can be triggered with water or hydrocarbons or with other materials already in the wellbore or introduced to it or other surface or locally actuated triggers.

DETAILED DESCRIPTION OF THE PREFERRED EMBODIMENT

Figure 4:
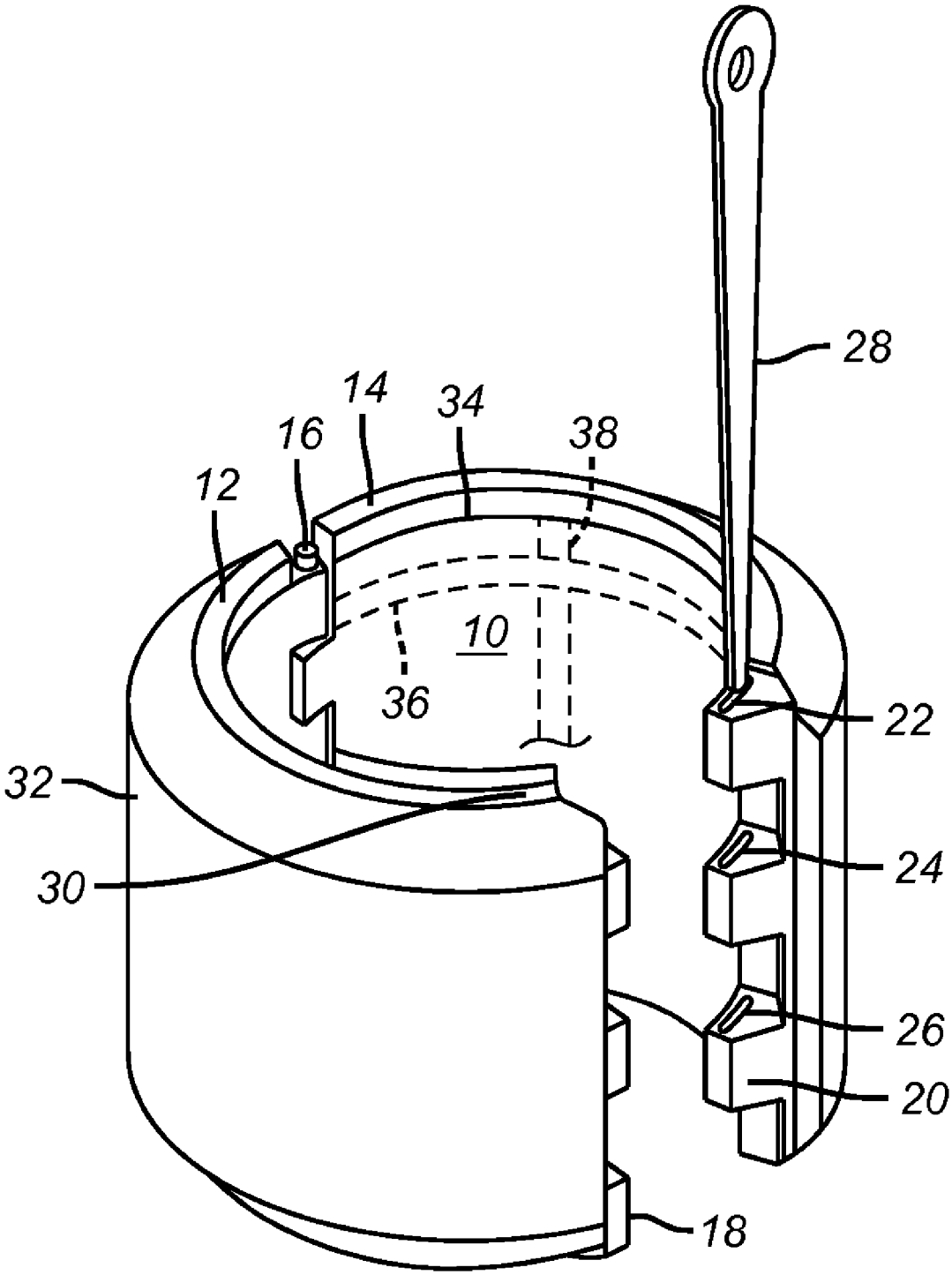
FIG. 4 is a perspective view of one type of clamshell body that can be used with a split swelling seal module.

The packer of the present invention is preferably a modular design that can be clamped around a tubular. In a schematic presentation, FIG. 4 illustrates the basic components. A body 10 can be made in two pieces 12 and 14 held together by a hinge 16. Optionally, the pieces 12 and 14 can be an integral construction that can flex enough to get the body 10 around a tubular while eliminating the hinge 16. Offset projections 18 and 20 are designed to nest when closed around a tubular. Progressively narrower aligned openings 22, 24 and 26 nest with their counterparts that are not shown to allow tapered pin 28 to be driven home to a position where it tightens the body 10 as much as possible to the tubular, then the tapered pin is trimmed off flush with the end 30. Preferably, the body 10 is surrounded by a swelling element 32 on the outside and 34 on the inside and going as far as spanning over offset projections 18 and 20 while still allowing them to approach each other and be firmly brought together when pin 28 is driven home. Use of swelling material 34 on the inside is also optional but is preferred for an enhanced sealing relation with the tubular to which it is being attached. Alternate designs can be used. For example, o-ring seals can be first advanced over an end of a tubular that is to be clamped with body 10 and body 10 can have internal grooves, such as 36, that accept such pre-positioned seal rings to get an interior seal between the tubular and the body 10. Optionally, if the body 10 is exposed, it can have one or more recesses 38 that are deeper than recesses 36 to allow control lines or other conduits to pass through the assembly when the element 32 has swelled. In that manner, the control lines or cable can be inside grooves 38 while still being sealed off against the tubular by virtue of seals in grooves 36. Vertical grooves 38 will need to be aligned if several modules such as shown on FIG. 2 are mounted together.

Figure 2:
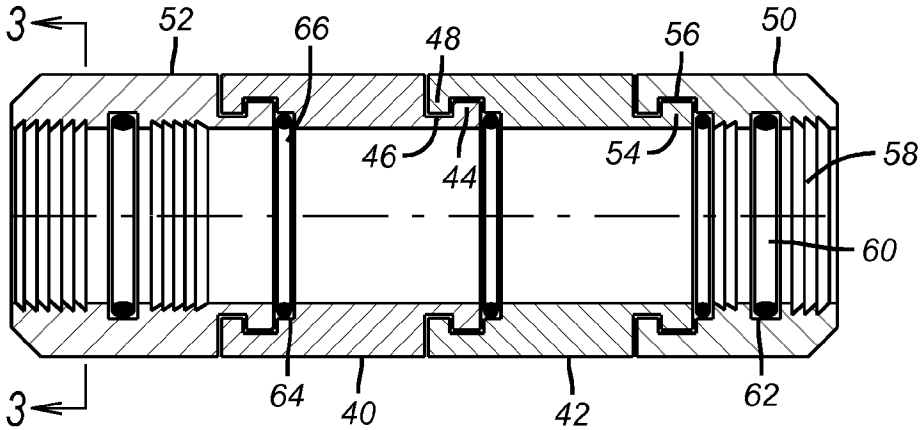
FIG. 2 is a section view through lines 2-2 of FIG. 1.

FIG. 2 illustrates the modular approach of using multiple components that are connected of the type is shown schematically in FIG. 4. For clarity, the body 10 that is preferably embedded in a swelling material is not illustrated. Instead, what is shown are modules 40 and 42. Module 40 has a ring 44 that fits into a groove in Module 46 to give the modules and overlapping and interlocking relation on assembly to the underlying tubular. Preferably, each module has this end connection feature so that two or more modules can be mounted in an interlocking relationship on the underlying tubular. At the ends of the module assembly is preferably an end ring such as 50 and 52. A ring 54 on Module 42 engages a groove 56 on module 50. Preferably, the same arrangement is to be found at the connection between end ring 52 and module 40. The end rings 50 and 52 preferably have an interior tooth profile 58 for a better grip of the underlying tubular and one or more rings 60 in a corresponding groove 62 to close off any leak path along the underlying tubular. Again, these features are optional and can be placed at one end or both ends or eliminated altogether. As another option a vertical groove can be put into the end rings 50 and 52 to allow control lines and cables of all types to pass through the assembly along the underlying tubular while isolated so as not to form a leak path for well fluids.

Each module 40 or 42 for example can have a circular groove 64 that can clamp over a seal ring 66 that has been split and placed around the tubular or stretched and applied over the end of the tubular and strategically located in position so that groove 64 will close over it when a module is fitted to the underlying pipe.

Figure 1:
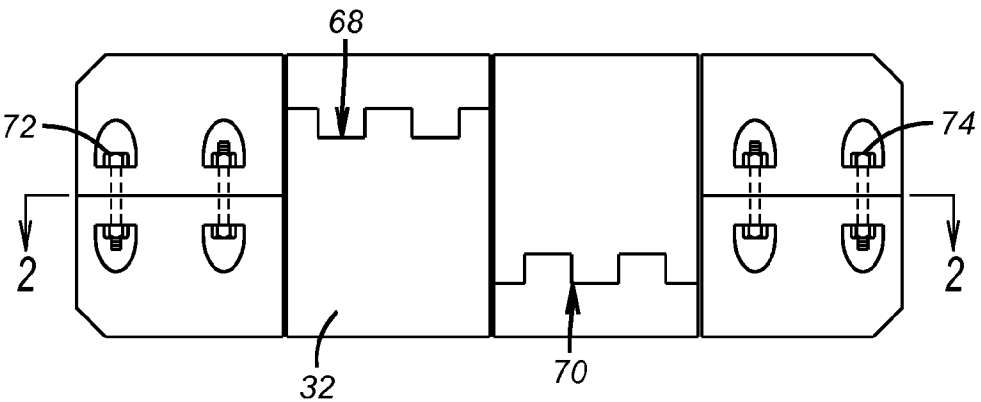
FIG. 1 is an outside view of a pair of sealing modules between retaining end components.

FIG. 1 shows that adjacent vertical closures 68 and 70 are circumferentially offset, akin to the splits in a stack of piston rings in a cylinder, to prevent an aligned path from existing and to further reduce the possibility of leakage under differential pressure. FIG. 1 also shows how the swelling material 32 on the exterior covers the offset projections 18 and 20 and dovetails into itself when the module such as 40 or 42 is secured to the underlying tubular.

Figure 3:
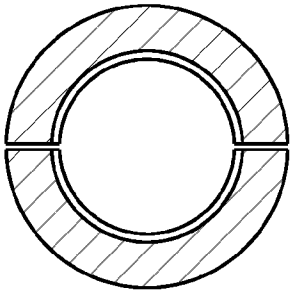
FIG. 3 is a section through lines 3-3 of FIG. 2.

FIG. 3 shows that end rings 50 and 52 can be a split ring or in two or more pieces that are hinged to make assembly to the underlying tubular go faster. FIG. 1 shows how external clamps 72 and 74 are preferably circumferentially offset from an adjacent vertical closure such as 68 or 70.

Those skilled in the art will appreciate that the swelling material 32 in each module such as for example 40 and 42 and another module (not shown) on the other side of 40 from 42 need not be identical. The swelling material in the modules may be responsive to water or hydrocarbon or some other common stimulus. The materials can also be formulated such that swelling happens faster at the middle of a bunch of modules such as at 40 and goes to the uphole and downhole ends such as at 42 in a manner to displace well fluids so as not to trap them during the swelling. In a given stack of modules, some can respond to different stimuli than others. In each module, it is preferred to have the swelling material positioned on the exterior and the interior of a body 10 such that swelling makes the material grow in opposed directions to seal against the casing or tubing or open hole on the exterior and against the internal tubular over which the module has been secured.

The above description is illustrative of the preferred embodiment and many modifications may be made by those skilled in the art without departing from the invention whose scope is to be determined from the literal and equivalent scope of the claims below.

We claim:

1. A packer for subterranean use in a bore and mounted on a tubular for sealing against a wall that defines the bore, comprising:

at least one longitudinally split housing adapted to be put onto the tubular from the side of a tubular further comprising a securing device for sealingly supporting said housing to the tubular;

at least one longitudinally split swelling non-inflatable element mounted to said housing and said housing defining a gap at said split which closes when said securing device secures said housing to the tubular, said element swells for selective sealing against the wall that defines the bore.

2. The packer of claim 1, wherein:

said housing is hinged.

3. The packer of claim 1, wherein:

said element is disposed on opposed sides of said housing for contact with the tubular and the wellbore.

4. The packer of claim 3, wherein:

said element comprises an axial groove facing the tubular to seal around one or more lines that pass through it.

5. The packer of claim 1, wherein:

said securing device comprises a plurality of loops adjacent said longitudinal split which nest when brought together.

6. The packer of claim 5, wherein:

said loops are formed to reduce the diameter of said housing a tapered elongated member that interacts with said loops to reduce the housing diameter when it is advanced through nested loops.

7. The packer of claim 1, wherein:

said at least one element comprises a plurality of elements that swell to different stimuli.

8. The packer of claim 1, wherein:

said at least one element comprises a plurality of elements that swell at different rates.

9. The packer of claim 1, wherein:

said housing comprises a circumferential groove; and a seal mounted in said groove for sealing against the tubular.

10. The packer of claim 1, wherein:

said housing comprises an axial groove facing the tubular to seal around one or more lines that pass through it.

11. The packer of claim 1, wherein:

said element is interlocked to said housing.

12. The packer of claim 11, wherein:

said interlocking comprises a ring on one extending into a groove on the other.

13. The packer of claim 11, wherein:

said element and said housing are axially stacked.

14. The packer of claim 13, wherein:

said at least one element comprises a plurality of elements with at least two that interlock each other.

15. The packer of claim 14, wherein:

said at least one housing comprises at least two housings that are axially spaced apart and surround at least two elements.

16. The packer of claim 15, wherein:

said elements further comprise a ring seal between them.

17. The packer of claim 13, wherein:

said longitudinal splits are circumferentially offset.

18. The packer of claim 13, wherein:

said housing comprises a gripping profile to engage the tubular.

19. The packer of claim 11, further comprising:

a seal ring between said element and said housing.

20. The packer of claim 1, wherein:

said housing comprises a gripping profile to engage the tubular.

* * * * *